United States Patent [19]

Goto

[11] Patent Number: 4,787,285

[45] Date of Patent: Nov. 29, 1988

[54] ANCHOR BOLT DEVICE FOR TREMOLD DEVICE

[75] Inventor: Takao Goto, Isezakishi, Japan

[73] Assignee: Gotoh Gut Yugen Kaisha, Gunmaken, Japan

[21] Appl. No.: 105,343

[22] Filed: Oct. 7, 1987

[51] Int. Cl.[4] ..... G10D 3/04

[52] U.S. Cl. ..... 84/313; 84/299

[58] Field of Search ..... 84/298, 299, 307, 313

[56] References Cited

U.S. PATENT DOCUMENTS

| | | | |
|---|---|---|---|
| 2,972,923 | 2/1961 | Fender | 84/313 |
| 3,971,286 | 7/1976 | Borell | 84/298 |
| 4,433,605 | 2/1984 | Matsui | 84/299 |
| 4,487,100 | 12/1984 | Storey | 84/299 |

*Primary Examiner*—Lawrence R. Franklin

*Attorney, Agent, or Firm*—Wenderoth, Lind & Ponack

[57] ABSTRACT

An anchor bolt device for a tremolo device which is constructed so that a bolt is thread-fitted to a bottomed and threaded tube which is buried to be open upwardly in a stringed instrument, said bolt being provided at its top part with a groove for securing the front edge portion of said tremolo device and at the center of the bolt in its axial direction with a through hole inside which a pushing member capable of shifting itself inside said through hole with an external operation is thread-fitted and being tightly fixed by protruding said pushing member from said through hole so that the lower end of said pushing member contacts under a pressure with the bottom of the tube after the position of the groove has been adjusted by shifting said bolt in the tube.

7 Claims, 3 Drawing Sheets

ANCHOR BOLT DEVICE FOR TREMOLD DEVICE

BACKGROUND OF THE INVENTION

The present invention relates to the anchor bolt device for use in a tremolo device of a stringed instrument.

This anchor bolt device is provided to secure the front end of the base of the tremolo device and serve as a pivot for pivotal motion of the tremolo device.

Therefore the conventional anchor bolt device comprises a bolt which is provided with a groove which engages with the front end of the base of the tremolo device in the circumferential direction and a threaded tube into which said bolt is thread-fitted to hold the bolt so that the position of the groove can be shifted and this tube is buried in a stringed instrument such as a guiter and the bolt is thread-fitted to said tube.

In case of this type of conventional anchor bolt device, the height position of the groove provided in the bolt is adjusted only in accordance with the amount of protrusion of the bolt from the threaded tube and therefore a clearance is unavoidably formed between the thread of the bolt and that of the threaded tube except for that the bolt is thread-fitted down to the bottom of the tube, and therefore, if the position of the groove is adjusted by fitting the bolt, there is a problem that the bolt plays to vary the position of the groove provided on the bolt during tremolo playing on the stringed instrument.

SUMMARY OF THE INVENTION

An object of the present invention is to provide the anchor bolt device for use in stringed instruments which is designed so that the position of the groove provided on the bolt can be adjusted as desired by shifting the bolt and the bolt can be firmly fixed after adjustment. For this object, the anchor bolt device in accordance with the present invention comprises the tube to be buried in a stringed instrument, the bolt to be thread-fitted to the inside of the tube and the pushing member which is protruded from the lower end of the bolt to come in contact with the inner bottom of the tube, said pushing member being designed to vary as desired the length of its protruded part by adjusting operation to be done by the player of the stringed instrument.

Another object of the present invention is to provide the anchor bolt device provided with the tube the inside of which can be easily cleaned when the bolt is removed from the tube.

For this object, a through hole is provided in the bottom of said tube and the bottom plate which forms the inner bottom is attached to this through hole to cover the through hole.

DETAILED DESCRIPTION OF PREFERRED EMBODIMENT

Figure 1:
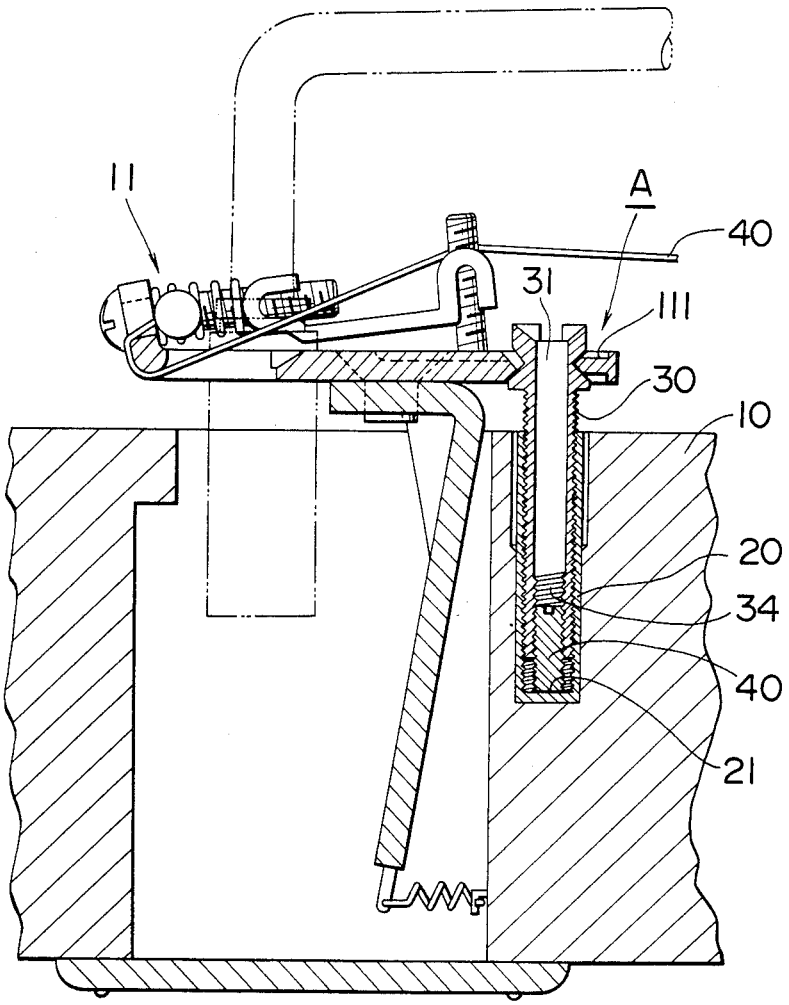
FIG. 1 is a vertical crosssectional view showing the important part of the guitar provided with the anchor bolt device in accordance with the present invention.

FIG. 1 shows the important part of a stringed instrument such as, for example, a guitar 10 which the anchor bolt device in accordance with the present invention is provided, and this guitar 10 is provided with the tremolo device 11.

Said tremolo device 11 is adapted as the conventional type to be secured with the anchor bolt device A in accordance with the present invention by the engaging means such as, for example, the engaging hole 111 which is provided at the front edge of the tremolo device and pivotally moved around the anchor bolt device A serving as the pivot.

The anchor bolt device A in accordance with the present invention in constructed to have the tube 20 which is buried and secured in the guitar 10, bolt 30 which is thread-fitted to the tube 20 and the pushing member 40 which is internally provided in said bolt 30.

Figure 2:
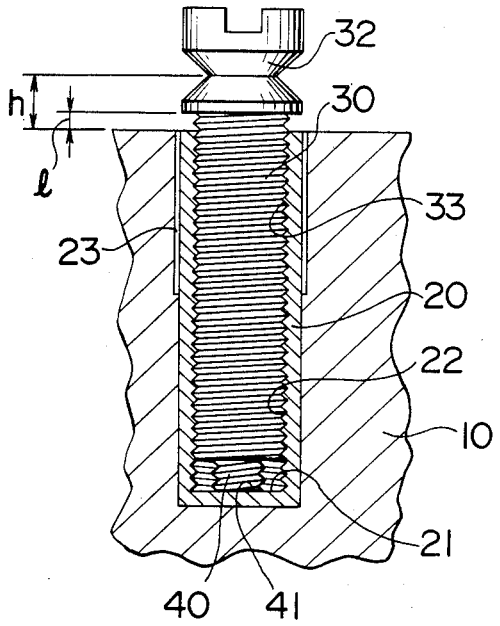
FIG. 2 is a vertical crosssectional side view showing a condition of the anchor bolt device in accordance with the present invention when it is used.

Said tube 20 is made as a bottomed tubular member which has the bottom 21 and is open upwardly and, as shown in FIG. 2, the internal thread 22 is provided by machining on the internal wall of the tube 20 and the engaging surface 23 is provided on the outer wall whereby the anchor bolt device A is thus firmly fixed to the guitar 10.

Figure 3:
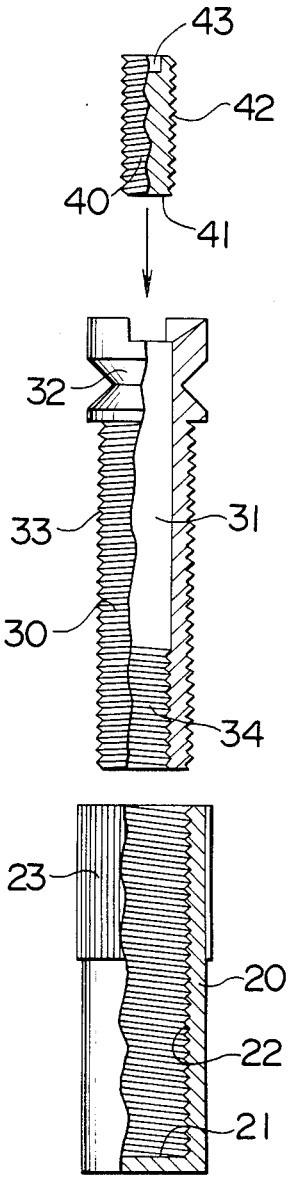
FIG. 3 is a partly cutaway disassembled view of the anchor bolt device according to the present invention.

Said bolt 30 is provided at its center with the through hole 31 along the axial direction as shown in FIG. 3, and at its top with the groove 32 in the circumferential direction to engage with the engaging hole 111 of said tremolo device 11, and at its center surface with the external thread 33 which meshes with the internal thread 22 of said tube 20. And the internal thread 34 which meshes with the pushing member 40 is provided on the inner wall of at least the lower part of the through hole 31.

Said pushing member 40 is set in the through hole 31 of said bolt 30 and thread-fitted inside the through hole 31 so that the lower end 41 of the pushing member 40 is protruded toward the bottom 21 of the tube 20 from the lower end of the through hole 31 and the threaded part 42 provided with the external thread which engages with the internal thread 34 of the bolt 30 is provided on the external surface of the pushing member.

In the embodiment, this threaded part 42 forms the pushing member 40 as a whole and, depending on the length of the pushing member 40, a part of the pushing member 40 can be made as the threaded part 42. Said pushing member 40 is formed to be shiftable inside the through hole 31 by an external operation and therefore, in the embodiment, as an operated means for this purpose, the top of the pushing member 40 is provided with the polygonal socket hole 43 into which a jig can be inserted from above the through hole 31 to make it possible to rotate the pushing member 40 in the through hole.

The anchor bolt device of the present invention is as described above. If the lower end 41 of said pushing member 40 is protruded from the through hole 31 by rotating the pushing member 40 with, for example, the jig to cause it to contact under pressure with the bottom surface 21 of the tube 20 after the height position h of the groove 32 has been determined by moving the bolt 30 in the tube 20 and drawing out it as far as the required length l from the body of guitar 10, a pushing force is applied to the bolt 30 in the axial direction and therefore the bolt 30 is firmly fixed to be unrotatable in the tube 20 due to tight contact of the thread 33 with the thread 22 of the tube 20 under the pressure of said pushing force. On the other hand, if the lower end 41 of pushing member 40 is released from the bottom surface 21 of tube 20 by reversely rotating the pushing member 40, the bolt 30 is released from the pushing force of the pushing member 40 and the position of the groove 32 can be adjusted by rotating again the pushing member 40.

Accordingly, the anchor bolt device in accordance with the present invention can positively prevent a trouble that the position of the groove 32 of bolt 30 varies during tremolo performance of the stringed instrument only by depressing the pushing member 40 against the bottom 21 of the tube after the protrusion length l of bolt 30 has been determined.

Figure 4:
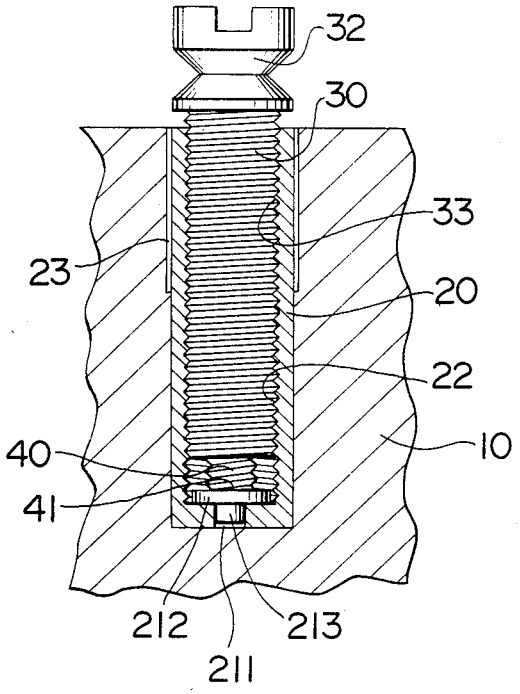
FIG. 4 is a vertical crosssectional side view showing another embodiment of the anchor bolt device in accordance with the present invention.

FIG. 4 shows another embodiment of the anchor bolt device in accordance with the present invention.

For easy understanding of the description, the same parts shown in FIG. 4 as those of the anchor bolt device shown in FIGS. 1 to 3 are given the same numbers as given in FIGS. 1 to 3.

In this embodiment, the bottom 21 of tube 20 is provided with the through hole 211 which is covered by the bottom plate 212 which comes in contact with the lower end of said pushing member 40 and substantially forms the bottom of the tube.

The bottom plate 212 is provided with the mount leg 213 to secure the position of the bottom plate 212 and this mount leg 213 is inserted into the through hole 211.

Preferably, said mount leg 213 can be made as a screw type part so that it can be thread-fitted to the inside of the through hole 211 which is made as a threaded hole.

This embodiment is advantageous in that oil and dusts which have intruded into the tube 20 can be removed from said through hole 211 and the plating liquid which may remain inside the tube 20 during plating in the manufacturing process for said tube 20 can be removed from the tube.

Heretofore, through said pushing member 40 can be made almost as long as said through hole 31, the pushing member 40 in the embodiment is made to be short and the internal thread 34 of the through hole 31 is partly provided under the through hole 31.

What is claimed is:

1. An anchor bolt device for a tremolo device comprising a bottomed tube which is buried to be open upwardly in a body of a stringed instrument and provided with an internal thread on its inner wall, a bolt which is provided on its outer surface with an external thread which meshes with the internal thread of said tube to allow to be thread-fitted into the tube from the opening of the tube so that the bolt can be moved in the tube, at the circumference of its top part with a groove for securing a front edge of a tremolo device, and at the center of the bolt in its axial direction with a through hole in which an internal thread is provided on an internal wall of at least the lower part of the bolt, and a pushing member which is threaded at least partly to be thread-fitted to the internal thread inside the through hole of said bolt and adapted so that the lower end of said pushing member can be moved as desired from the lower end of the through hole toward the bottom of the tube by an external operation, wherein said bolt is fixed to the internal thread of the tube by depressing said pushing member onto the bottom of said tube.

2. An anchor bolt device in accordance with claim 1, wherein said pushing member is made to be short and thread-fitted to the lower part of the through hole of said bolt.

3. An anchor bolt device in accordance with claim 2, wherein the internal thread of said through hole is provided only at the lower part of the through hole.

4. An anchor bolt device in accordance with claim 1, wherein the top of said pushing member is provided with a socket hole which receives a jig inserted from above said bolt.

5. An anchor bolt device in accordance with claim 1, wherein a through hole is provided in the bottom of said tube and a bottom plate is placed on the bottom of the tube to cover said through hole.

6. An anchor bolt device in accordance with claim 5, wherein a mount leg which is inserted into said through hole is provided on said bottom plate.

7. An anchor bolt device in accordance with claim 6, wherein said mount leg is threaded and said through hole is threaded to mesh with the thread of said mount leg.

* * * * *